US006241012B1

(12) United States Patent
Yu et al.

(10) Patent No.: US 6,241,012 B1
(45) Date of Patent: Jun. 5, 2001

(54) FOLDED TUBE FOR A HEAT EXCHANGER AND METHOD OF MAKING SAME

(75) Inventors: Wen Fel Yu, Ann Arbor; Eugene E Rhodes, Bellville; Greg Whitlow, Whitmore Lake, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/458,459

(22) Filed: Dec. 10, 1999

(51) Int. Cl.[7] ..... F28F 1/06

(52) U.S. Cl. ..... 165/177; 165/179; 165/183; 165/174; 29/890.049

(58) Field of Search ..... 165/153, 177, 165/183; 29/890.053, 890.045, 890.049; 138/38

(56) References Cited

U.S. PATENT DOCUMENTS

| | | | | |
|---|---|---|---|---|
| 3,486,489 | | 12/1969 | Huggins . | |
| 4,600,053 | | 7/1986 | Patel et al. . | |
| 5,036,911 | | 8/1991 | So et al. . | |
| 5,185,925 | * | 2/1993 | Ryan et al. | 29/890.049 |
| 5,186,250 | * | 2/1993 | Ouchi et al. | 165/177 |
| 5,386,629 | * | 2/1995 | Ouchi et al. | 29/890.046 |
| 5,441,105 | * | 8/1995 | Brummett et al. | 165/153 |
| 5,441,106 | * | 8/1995 | Yukitake | 165/183 |
| 5,638,897 | | 6/1997 | Hirano et al. . | |
| 5,979,051 | * | 11/1999 | Kato et al. | 29/890.049 |
| 6,000,467 | * | 12/1999 | Tokizaki et al. | 165/177 |

FOREIGN PATENT DOCUMENTS

| | | |
|---|---|---|
| 3037873 | 3/1982 | (DE) . |
| 1271705 | 12/1963 | (FR) . |
| 2223091 | 3/1990 | (GB) . |
| 2000534 | 9/1993 | (RU) . |

* cited by examiner

*Primary Examiner*—James C. Yeung
*Assistant Examiner*—Terrell McKinnon
(74) *Attorney, Agent, or Firm*—Larry I. Shelton

(57) ABSTRACT

A folded tube and method of making the same for a heat exchanger includes a base, a top spaced from and opposing the base, a first side interposed between the base and the top along one side thereof, and a second side interposed between the base and the top along another side thereof. The folded tube includes at least one of the base and the top having at least one internal web having an initial web width and initial outside shoulder radius and being compressed to compress the at least one internal web to a final web width less than the initial web width and a final outside shoulder radius less than the initial outside shoulder radius and defining a plurality of fluid ports.

20 Claims, 3 Drawing Sheets

FOLDED TUBE FOR A HEAT EXCHANGER AND METHOD OF MAKING SAME

BACKGROUND OF THE INVENTION

1. Field of the Invention

The present invention relates generally to heat exchangers for motor vehicles and, more specifically, to a folded tube and method of making same for a heat exchanger in a motor vehicle.

2. Description of the Related Art

It is known to provide a tube for a heat exchanger such as a condenser in an air conditioning system of a motor vehicle. The tube typically carries a first fluid medium in contact with its interior while a second fluid medium contacts its exterior. Typically, the first fluid medium is a liquid or a two-phase liquid and gas mixture and the second fluid medium is a gas. Where a temperature difference exists between the first and second fluid mediums, heat will be transferred between the two via heat conductive walls of the tube.

It is also known to provide corrugated fins or ribs in the interior of the tube to increase the surface area of conductive material available for heat transfer to cause turbulence of the fluid carried in the interior of the tube and to increase the burst strength of the tube. One known method of making such a tube is to physically insert a corrugated fin into the generally flattened tube after the tube has been manufactured. This is an extremely difficult process since the corrugated fin to be inserted into the tube is extremely thin and subject to deformation during the insertion process.

Another known method of forming a tube for a heat exchanger is to extrude the tube in an extrusion process. In this construction, internal ribs are formed during the extrusion. However, these extruded tubes are relatively expensive to produce.

Yet another known method of forming a tube for a heat exchanger is to provide a flat, elongated sheet with lugs and the ends of the sheet are folded to form the tube. The ends of the tube are then brazed. An example of such a tube is disclosed in U.S. Pat. No. 5,386,629. In this patent, the tube may have flow paths between the lugs. However, the quality of the folded tube to header joints is related to how small the outside web shoulders can be with the smaller the better to prevent leakage.

It is desirable to provide a folded tube with very small outside web shoulder radii. It is also desirable to provide a method to achieve small web shoulder for a folded tube. It is further desirable to provide a folded tube for enhancing heat transfer of the heat exchanger. Therefore, there is a need in the art to provide a folded tube for a heat exchanger of a motor vehicle that achieves these desires.

SUMMARY OF THE INVENTION

Accordingly, the present invention is a folded tube for a heat exchanger. The folded tube includes a base, a top spaced from and opposing the base, a first side interposed between the base and the top along one side thereof, and a second side interposed between the base and the top along another side thereof. The folded tube also includes at least one of the base and the top having at least one internal web having an initial web width and an initial outside shoulder radius and being compressed to compress the at least one internal web to a final web width less than the initial web width and a final outside shoulder radius less than the initial outside shoulder radius and defining a plurality of fluid ports.

Also, the present invention is a method of making a folded tube for a heat exchanger. The method includes the steps of providing a generally planar sheet, folding the sheet, and forming at least one internal web having a first fold portion and a second fold portion. The method also includes the steps of compressing the at least one internal web to compress a width and outside shoulder radius of the at least one internal web. The method further includes the steps of folding the sheet and forming a base and a top opposing the base and a first side interposed between the top and the base and a second side interposed between the top and the base such that the at least one internal web contacts either one of the top or the base to provide a plurality of fluid ports.

One advantage of the present invention is that a folded tube for a heat exchanger such as a condenser is provided for an air conditioning system of a motor vehicle for condensing liquid refrigerant. Another advantage of the present invention is that the folded tube is stamped and folded and is more economical to manufacture than an extruded tube. Yet another advantage of the present invention is that the folded tube has a small web shoulders for better brazing to minimize the number of potential leaks in manufacturing. Still another advantage of the present invention is that a method of making the folded tube is provided by coining metal inside to achieve very small outside web shoulder radii. A further advantage of the present invention is that the folded tube may have the webs enhanced with vertical serrations to achieve fluid mixing and enhance heat transfer of the heat exchanger. Yet a further advantage of the present invention is that a method of making the folded tube is provided by enhancing the webs by vertical serrations introduced by special rolls during web coining to achieve fluid mixing, eliminating the need for secondary turbulators.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
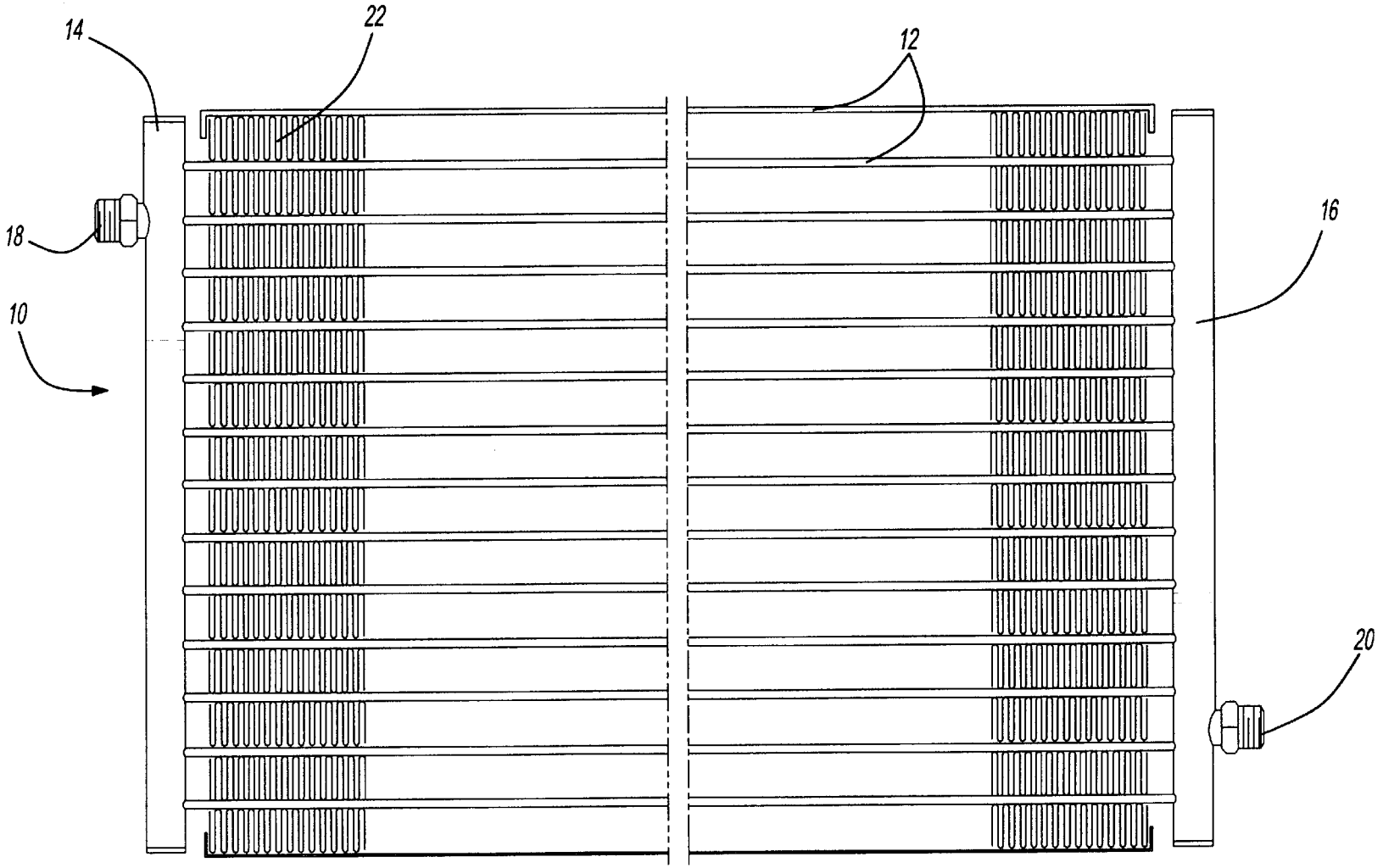
FIG. 1 is an elevational view of a folded tube, according to the present invention, illustrated in operational relationship with a heat exchanger of a motor vehicle.

Referring to the drawings and in particular FIG. 1, one embodiment of a heat exchanger 10, according to the present invention, such as a condenser for an air conditioning system (not shown), is shown for a motor vehicle (not shown). The heat exchanger 10 includes a plurality of generally parallel folded tubes 12, according to the present invention, extending between oppositely disposed headers 14, 16. The heat exchanger 10 includes a fluid inlet 18 for conducting cooling fluid into the heat exchanger 10 formed in the header 14 and an outlet 20 for directing cooling fluid out the heat exchanger 10 formed in the header 16. The heat exchanger 10 also includes a plurality of convoluted or serpentine fins 22 attached to an exterior of each of the tubes 12. The fins 22 are disposed between each of the tubes 12. The fins 22 conduct heat away from the tubes 12 while providing additional surface area for convective heat transfer by air flowing over the heat exchanger 10. It should be appreciated that, except for the folded tube 12, the heat exchanger 10 is conventional and known in the art. It should also be appreciated that the folded tube 12 could be used for heat exchangers in other applications besides motor vehicles.

Referring to FIGS. 2 through 8, the folded tube 12 extends longitudinally and is substantially flat. The folded tube 12 includes a base 24 being generally planar and extending laterally. The folded tube 12 also includes a top 26 spaced from the base 24 a predetermined distance and opposing each other. The top 26 is generally planar and extends laterally. The folded tube 12 includes a first side 28 interposed between the base 24 and the top 26 along one side thereof. The first side 28 is generally arcuate in shape. The folded tube 12 also includes a second side 30 interposed between the base 24 and the top 26 along the other side and opposing the first side 28. The folded tube 12 has a generally rectangular cross-sectional shape. It should be appreciated that the folded tube 12 may have any suitable cross-sectional shape.

Figure 2:
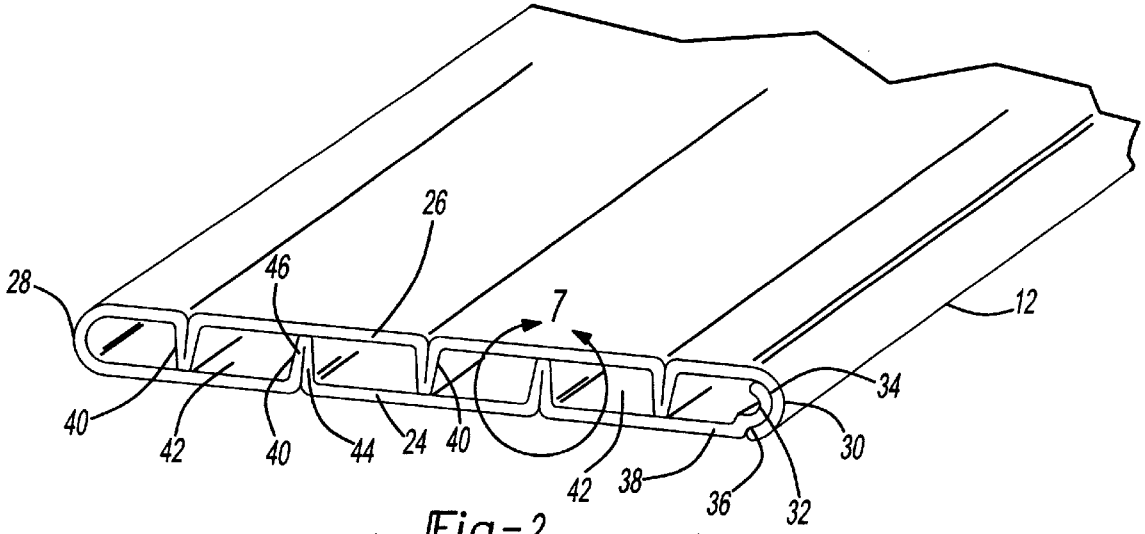
FIG. 2 is a partial perspective view of the folded tube of FIG. 1.

Referring to FIG. 2, the second side 30 is generally arcuate in shape and formed from a first end 32 of the base 24 and a second end 34 of the top 26. The first end 32 is generally arcuate in shape and has a recess 36 formed by a shoulder 38 extending inwardly. The second end 34 is generally arcuate in shape and overlaps the first end 32 and terminates in the recess 36 to produce a substantially flush outer periphery of the second side 30. The first side 28 has a single wall thickness while the second side has a double wall thickness for extra strength against stone chips while driving the motor vehicle. Preferably, the wall thickness for the folded tube 12 has a maximum of 0.35 millimeters. It should be appreciated that the base 24, top 26, first side 28 and second side 30 form a hollow channel or interior for the folded tube 12.

Figure 7:
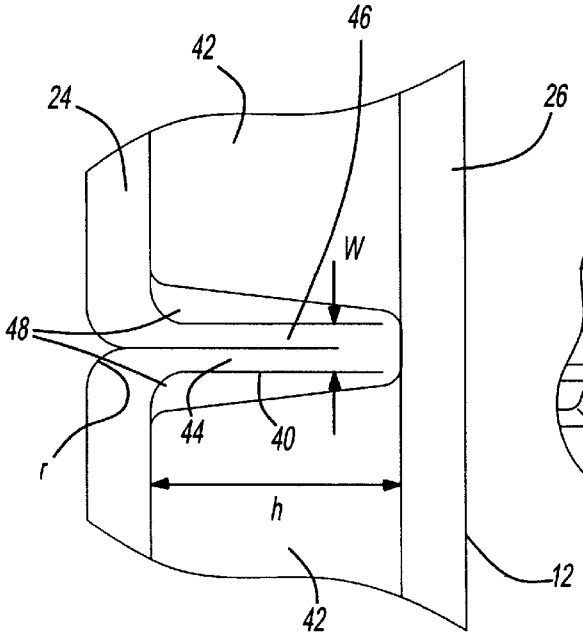
FIG. 7 is an enlarged elevational view of a portion of the folded tube in circle 7 of FIG. 2.
Figure 8:
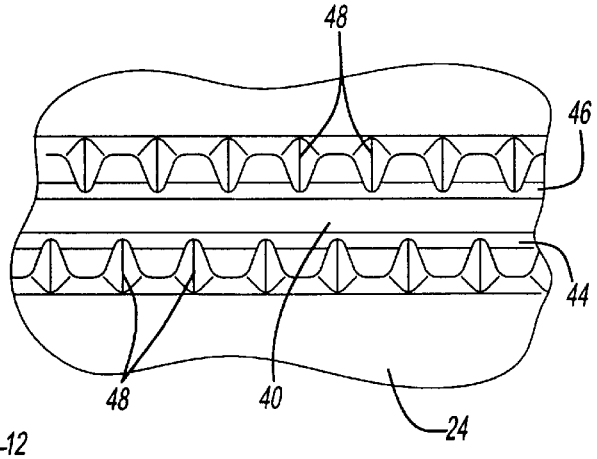
FIG. 8 is an enlarged plan view of the portion of the folded tube of FIG. 7.

Referring to FIGS. 2, 7 and 8, the folded tube 12 includes at least one, preferably a plurality of internal webs 40 extending from either one of or both the base 24 and top 26 to form a plurality of ports or flow paths 42 in the interior of the folded tube 12. In the embodiment illustrated, the base 24 has two internal webs 40 spaced laterally and extending longitudinally and upwardly. The top 26 has three internal webs 40 spaced laterally and extending longitudinally and downwardly. The internal webs 40 extend in alternate directions such that one of the internal webs 40 on the base 24 is disposed between a pair of internal webs 40 on the top 26 to form six ports 42. It should be appreciated that the number of internal webs 40 can be varied to produce the number of ports 42 desired.

Each of the internal webs 40 extends longitudinally and has a first portion 44 and a second portion 46. The internal web 40 is formed by folding the first fold portion 44 and second fold portion 46 of the base 24 and/or top 26 back on itself for an initial predetermined internal web height and a predetermined internal web width or thickness and an initial predetermined outside shoulder radius. In the embodiment illustrated, the initial predetermined internal web height is approximately 0.7812 mm with a uniform initial predetermined internal web width of approximately 0.68 mm and an initial predetermined outside shoulder radius of 0.12 mm. It should be appreciated that the initial predetermined web thickness is uniform.

Referring to FIG. 7, after the internal web 40 is initially formed, it is compressed or laterally extruded by a conventional process such as coining to compress the width of the internal web 40 at its base to achieve a relatively small outside shoulder radius (r). In the embodiment illustrated, the internal web 40 has a final predetermined internal web height (h) and predetermined internal web width or thickness (w) and predetermined outside shoulder radius (r). In the embodiment illustrated, the final predetermined web height (h) is approximately 1.4 mm and the final predetermined internal web thickness (w) is approximately 3.0 mm and the final outside shoulder radius (r) is approximately 0.10 mm at its base. In the embodiment illustrated, internal webs 40 may be enhanced by vertical serrations 48 extending laterally outwardly from either one or both of the first fold portion 44 and second fold portion 46. The serrations 48 are spaced longitudinally along the first fold portion 44 and second fold portion 46 to resemble a plurality of peaks and valleys along the entire length of the web 40. The serrations 48 are vertically orientated to the flow of fluid through the ports 42. The serrations 48 are like tiny teeth to provide fluid mixing and more internal surface area for heat transfer. After the internal web 40 is initially formed, the serrations 48 are formed by special rolls to be described during by a conventional process such as coining. It should be appreciated that the serrations 48 may be formed without coining the outside shoulder of the webs 40 and that the outside shoulder of the webs 40 may be coined without forming the serrations 48 as a result of the lateral extrusion. It should also be appreciated that the internal webs 40 may be enhanced other than by the serrations 48 to provide more fluid mixing and heat transfer. It should further be appreciated that the internal webs 40 maintain a predetermined distance or spacing between the base 24 and the top 26.

The folded tube 12 has the internal webs 40 laterally spaced to provide the ports 42 with a predetermined hydraulic diameter. The hydraulic diameter is defined as the cross-sectional area of each of the flow paths or ports 40 multiplied by four and divided by a wetted perimeter of the corresponding flow path or port 42. Although a smaller hydraulic diameter results in better heat transfer, the hydraulic diameter is preferably greater than 0.050 inches and, more preferably, greater than 0.070 inches to achieve efficient heat transfer. For example, the port 42 may have a cross-sectional area of 3.71 mm and a wetted perimeter of 8.25 mm for a hydraulic diameter of 0.0708 inches or 1.798 mm.

The folded tube 12 has its inner and outer surfaces coated with a known brazing material. As a result, the brazing material flows between the first end 32 of the base 24 and the second end 34 of the top 26 by capillary flow action to braze the ends together. Also, the brazing material flows between the peak of the internal webs 40 and the base 24 and top 26 to braze them together.

Figure 3:
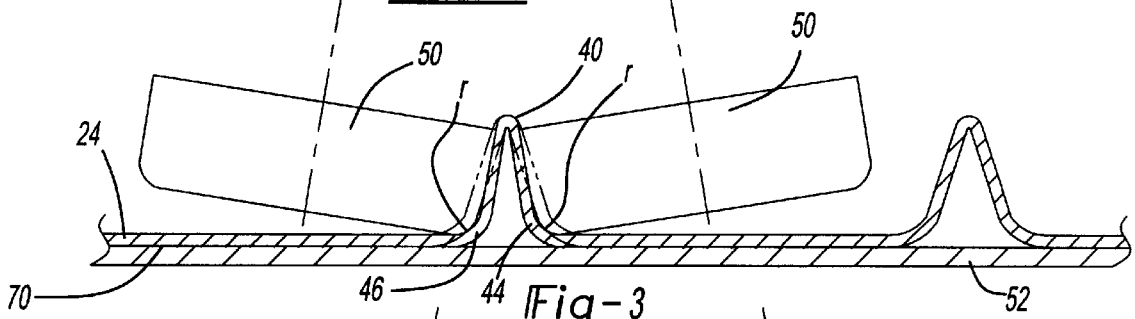
FIGS. 3 through 5 are fragmentary elevational views illustrating steps of a method, according to the present invention, of making the folded tube of FIG. 1.
Figure 4:
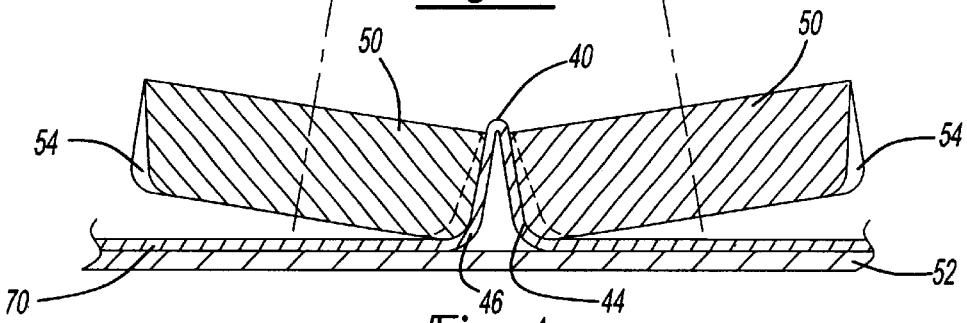
Figure 5:
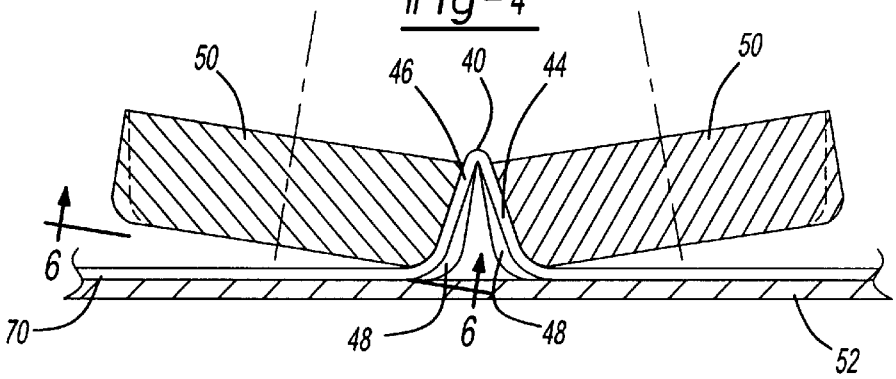
Figure 6:
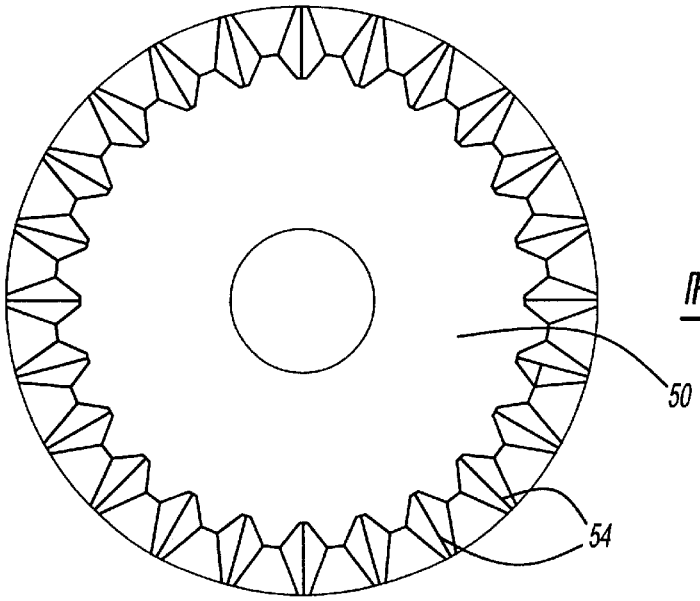
FIG. 6 is a plan view taken along line 6—6 of FIG. 5.

Referring to FIGS. 3 through 6, a method, according to the present invention, of the making the folded tube 12 is shown. The method includes the steps of providing a generally planar sheet 70 of elongate, deformable material coated with a braze material forming the base 24 and top 26 having their respective ends 32 and 34 edges along a longitudinal length thereof. The ends 32 and 34 of the base 24 and top 26 can be either flat or arcuate. The method includes the step of folding the sheet 70 from the lateral sides to initially form the internal webs 40 with the first fold portion 44 and second fold portion 46 to an initial predetermined web height, width and outside shoulder radius as illustrated in FIG. 3. The method also includes the step of compressing the internal webs 40 by lateral extrusion to compress the internal webs 40 to a final predetermined web width as illustrated in FIG. 3. The step of compressing also includes the step of coining the outside shoulder radiuses of the webs 40 by upper angular rollers 50 while supporting the sheet 70 with a lower planar roller 52. As illustrated in FIG. 6, the method may include providing the upper angular rollers 50 with projections or serrations 54 about a circumference thereof. The method may include the step of forming a plurality of serrations 48 along the web 40 by the projections 54 on the upper angular rollers 50 during the step of web coining as illustrated in FIGS. 4 and 5. The method includes the step of folding the ends 32 and 34 toward one another until they meet to form the first side 28 and second side 30 and ports 42 and connecting the ends 32 and 34 together as illustrated in FIG. 2. The method includes the step of brazing the folded tube 12 by heating the folded tube 12 to a predetermined temperature to melt the brazing material to braze the ends 32 and 34 and the internal webs 44 to the base 24 and/or top 26. The folded tube 12 is then cooled to solidify the molten braze material to secure the ends 32 and 34 together and the internal webs 44 and the base 24 and top 26 together. It should also be appreciated that the folded tube 12 may be formed as described above except that the serrations 48 are formed during the step of compressing by the lateral extrusion.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A folded tube for a heat exchanger comprising:

a base;

a top spaced from and opposing said base;

a first side interposed between said base and said top along one side thereof;

a second side interposed between said base and said top along another side thereof; and at least one of said base and said top having at least one internal web having an initial web width and an initial outside shoulder radius being compressed to compress said at least one internal web to a final web width less than said initial web width and a final outside shoulder radius less than said initial outside shoulder radius and defining a plurality of fluid ports, said at least one internal web having a first fold portion and a second fold portion adjacent said first fold portion and being formed from one of said base and said top, said at least one internal web having at least one enhancement with a base and a peak formed from either one of said first fold portion and said second fold portion and said base having a width greater than said peak.

2. A folded tube as set forth in claim 1 wherein said at least one internal web has a plurality of enhancements to mix the fluid flowing through said fluid ports.

3. A folded tube as set forth in claim 2 wherein said enhancements comprise a plurality of serrations extending laterally outwardly and longitudinally along said at least one web.

4. A folded tube as set forth in claim 1 including a plurality of enhancements along at least either one of said first fold portion and said second fold portion to mix fluid flowing through said ports.

5. A folded tube as set forth in claim 4 wherein said enhancements comprise a plurality of serrations.

6. A folded tube as set forth in claim 1 wherein said base includes a plurality of first internal webs and said top includes a plurality of second internal webs.

7. A folded tube as set forth in claim 6 wherein said first internal webs extend in one direction and the second internal webs extend in an opposite direction.

8. A folded tube as set forth in claim 6 wherein said first internal webs contact said second internal webs.

9. A folded tube as set forth in claim 6 including a partition extending from said top to said base and defining a pair of adjacent ports, said partition including a pair of opposing, contacting bend portions and a leg portion depending from each of said bend portions so as to contact said base.

10. A folded tube as set forth in claim 6 wherein said second side has a first end on said base and a second end on said top and overlapping said first end.

11. A folded tube as set forth in claim 6 wherein said internal webs includes either one of projections and recesses to enhance fluid flow.

12. A method of making a folded tube for a heat exchanger comprising the steps of:

providing a generally planar sheet;

folding the sheet and forming at least one internal web having a first fold portion and a second fold portion;

compressing the at least one internal web to compress a width and outside shoulder radius of the at least one internal web;

forming at least one enhancement on the at least one internal web with a base and a peak formed from either one of the first fold portion and the second fold portion with the base having a width greater than the peak; and folding the sheet and forming a base and a top opposing the base and a first side interposed between the top and the base and a second side interposed between the top and the base such that the at least one internal web contacts either one of the top or the base to provide a plurality of fluid ports.

13. A method as set forth in claim 12 including the step of squeezing the at least one internal web to reduce a width of the at least one internal web.

14. A method as set forth in claim 12 including the step of coining the at least one internal web to reduce the outside shoulder radius on the at least one internal web.

15. A method as set forth in claim 12 including the step of forming a plurality of enhancements on the at least one internal web.

16. A method as set forth in claim 15 wherein said step of forming a plurality of enhancements comprises coining the at least one internal web to form a plurality of serrations.

17. A method as set forth in claim 15 wherein said step of coining comprises providing a plurality of rollers having projections extending circumferentially thereabout and rolling the rollers along the at least one internal web to form the serrations along a longitudinal length of the at least one internal web.

18. A method as set forth in claim 15 wherein said step of forming a plurality of internal webs and alternating the internal webs to extend in opposite directions.

19. A method as set forth in claim 15 including the step of providing the sheet with terminal ends and folding the terminal ends toward each other in an overlapping manner to form the second side.

20. A folded tube for a heat exchanger comprising:

a base;

a top spaced from and opposing said base;

a first side interposed between said base and said top along one side thereof;

a second side interposed between said base and said top along another side thereof; and said base and said top each having at least one internal web spaced laterally from each other and having an initial web height and an initial outside shoulder radius being compressed to compress said at least one internal web to a final web width less than said initial web width and a final outside shoulder radius less than said initial outside shoulder radius and defining a plurality of fluid ports, said at least one internal web having a first fold portion and a second fold portion adjacent said first fold portion, said at least one internal web having at least one enhancement with a base and a peak formed from either one of said first fold portion and said second fold portion and said base having a lateral width greater than a lateral width of said peak, said base and said top and said first side and said second side and said at least one internal web being integral, unitary, and one-piece.

* * * * *